United States Patent [19]

Lauener

[11] Patent Number: 4,794,978

[45] Date of Patent: Jan. 3, 1989

[54] SIDE DAM FOR A CONTINUOUS CASTING MACHINE

[75] Inventor: Wilhelm F. Lauener, Gerlafingen, Switzerland

[73] Assignee: Larex AG, Recherswil, Switzerland

[21] Appl. No.: 64,697

[22] Filed: Jun. 22, 1987

[30] Foreign Application Priority Data

Jul. 1, 1986 [CH] Switzerland ..... 2643/86
Aug. 25, 1986 [CH] Switzerland ..... 3410/86

[51] Int. Cl.[4] ..... B22D 11/06
[52] U.S. Cl. ..... 164/431; 164/481
[58] Field of Search ..... 164/479, 481, 430, 431

[56] References Cited

U.S. PATENT DOCUMENTS 2,640,235 6/1949 Hazelett .
3,342,251 9/1967 Nagin et al. .
3,865,176 2/1975 Dompas et al. .
4,617,980 10/1986 Banninger ..... 164/479 X
4,632,176 12/1986 Pearce .

FOREIGN PATENT DOCUMENTS 1043135 11/1953 France .
59-199154 11/1984 Japan .

*Primary Examiner*—Kuang Y. Lin
*Attorney, Agent, or Firm*—Marks Murase & White

[57] ABSTRACT

A side dam consisting of elements is arranged laterally of the casting nozzle and the casting mold. The side dam with the elements travels over two pulleys. Each element consists of a carrier and an easily exchangeable block which is connected to the carrier. Each carrier is supported at one end on a guide rail and a pulley by way of a foot and is swivel mounted at the other end to the foot of the neighboring element by way of a connection rod. By these measures optimum conditions are provided so that the side dam travels at a constant speed, despite the application of relatively long elements. Defect blocks can be exchanged during operation. The side dam's plane of motion is parallel to the mold wall's planes of motion and the side dam can herewith be adjusted at any desired depth between the casting mold walls, whereby the width of the cast product is determined.

15 Claims, 4 Drawing Sheets

SIDE DAM FOR A CONTINUOUS CASTING MACHINE

BACKGROUND OF THE INVENTION

The invention deals with a side dam for the lateral closing off of the casting cavity of a continuous casting machine, said side dam consisting of elements that are linked in a chain like manner, which join together between the walls of the mold, close off the cavity and travel along with the casting, whereby the path of motion of the side dam lies in a plane which is parallel to the planes of the mold walls in the area of the casting cavity.

Usually, side dams for the above mentioned purpose consist of an endless, flexible steel strip or wire cable to which cuboid shaped blocks are fastened. The proportions of the blocks are around 40 to 60 mm length, 40 to 60 mm width, and their hight corresponds to the thickness of the strip or billet to be cast.(Hermann, Handbuch des Stranggiessens, p. 49, drawing 140, 142)

Conventional side dams are considered as wearing parts, whereby their production is costly, and handling and installation in the casting machine are extremely inconvenient.

The endless side dams of most of the continuous casting machines circulate in the same plane as the mold wall elements. The inner surfaces that limit the casting cavity laterally must therefore be level, so that the elements can leave the plane of the cast strip transversally at the point where the elements change their direction of motion on the exit side of the machine U.S. Pat. Nos. 3,342,251 and 3,865,176 and FR-A No. 1 043 135 and Patent Abstracts of Japan, volume 9, No. 67 (M-366) (1970), Mar. 27 1985; JP-A No. 59 199 154).

It has been suggested to arrange for the side dams to move in a plane parallel to the mold's plane of motion in the area of the casting cavity (U.S. Pat. Nos. 2,640,235 and 4,632,176). The individual elements of the side dam are thereby rigidly connected to links of a chain, which is led over deflection pulleys or chain wheels on the entry and the exit side of the the casting cavity. This design neither allows optimum guidance nor best sealing effect. Furthermore it does not allow an optimum motion of the side dam elements in the area of the casting cavity and at the same time in the area of the element's changing of direction. Particularly, there is a pending danger that the hind edges of the elements, in reference to the direction of their motion, will penetrate into the cast product on the exit side of the machine.

SUMMARY OF THE INVENTION

It is a first goal of the present invention to give a solution to these problems and to ensure optimum guidance, sealing effect and motion of the side dam elements in the area of the casting cavity as well as, and particularly in the area of the side dam element's changing of direction. The solution consists in furnishing the elements with a foot piece which is connected to one of the neighboring foot pieces on one side by means of a pivot and to the neighboring foot piece on the other side by means of a pivot mounted connection rod. Due to these special pivot connections of the side dam element's particular foot pieces, an optimum course of motion of the side dam elements can be obtained.

The known type of side dams with the cuboid shaped blocks attached to flexible steel strips, chains or wire cables do not allow the use of long blocks and besides troubles would occur in maintaining a constant speed of the side dams in the area of the casting cavity and furthermore in maintaining a constant bilateral distance of the side dams in case the side dams are travelling in a plane which coincides with the plane of motion of the cast. The invention therefore also deals with the solution to place a foot between neighboring elements which both elements have in common and to which both elements are pivoted and which feet serve as supporting and guiding parts.

The problems are solved by allowing for the elements, while changing their direction to move to a certain degree in relation to each other in the radial and in the circumferential direction and independantly of a pulling device such as a chain, but by having them be rigidly guided and practically held stationary in relation to each other and having them travel at a constant speed when they are in the area of the casting cavity. This solution allows the use of longer elements such as 100 to 250 mm and more which is additionally advantageous in regard to the production costs and substantially reduces the loss of time due to the changing of a side dam.

The mentioned, known side dams have a limited durability due to thermal and mechanical strains and often are the cause of trouble and interruptions in operation. It is a further goal of the present invention to make substantial improvements in this respect also. The solution is given by making the elements of the side dam consist of a support piece, furtheron called carrier which is linked to the other carriers in a chain like manner and of an exchangable block, whereby each block is connected to its corresponding carrier by means of an easily detachable holding device. Thereby it is made possible to replace individual damaged blocks even during operation, so that interruptions in the working process will occur much less frequently than with conventional machines. The easy exchangeability of the blocks is particularly promoted if the side dam's circulatory path of motion is put into a plane that is parallel to the planes of the mold side walls, as mentioned above in the first solution suggestion. Blocks that are to be exchanged can then be removed and replaced on the outside portion of the side dam's path of motion.

The side dam can be moved by the friction which is produced by the casting belts and the cast, or it can be driven by means of a drive.

In order to avoid the cast material to flow out from in between the side ends of the nozzle tip and the side dams, it is advantageous to arrange for the side dams to be pressed elastically against the tip's side ends.

BRIEF DESCRIPTION OF THE DRAWINGS

The invention will now be explained more in detail by means of a carried out example and two further variants illustrated in the drawings.

DESCRIPTION OF PREFERRED EMBODIMENTS

Figure 1:
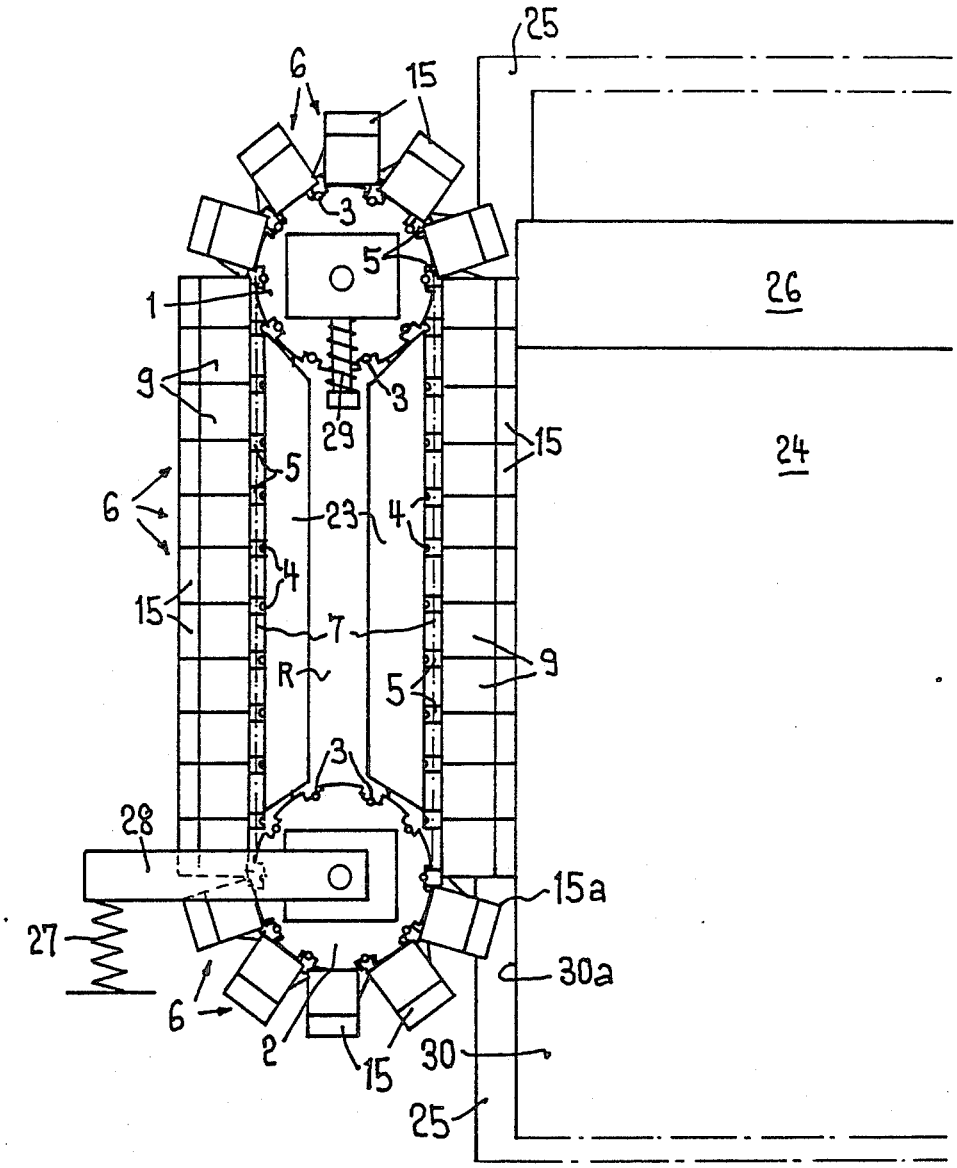
FIG. 1 shows a side dam with the essential neighboring components of a continuous casting machine.
Figure 2:
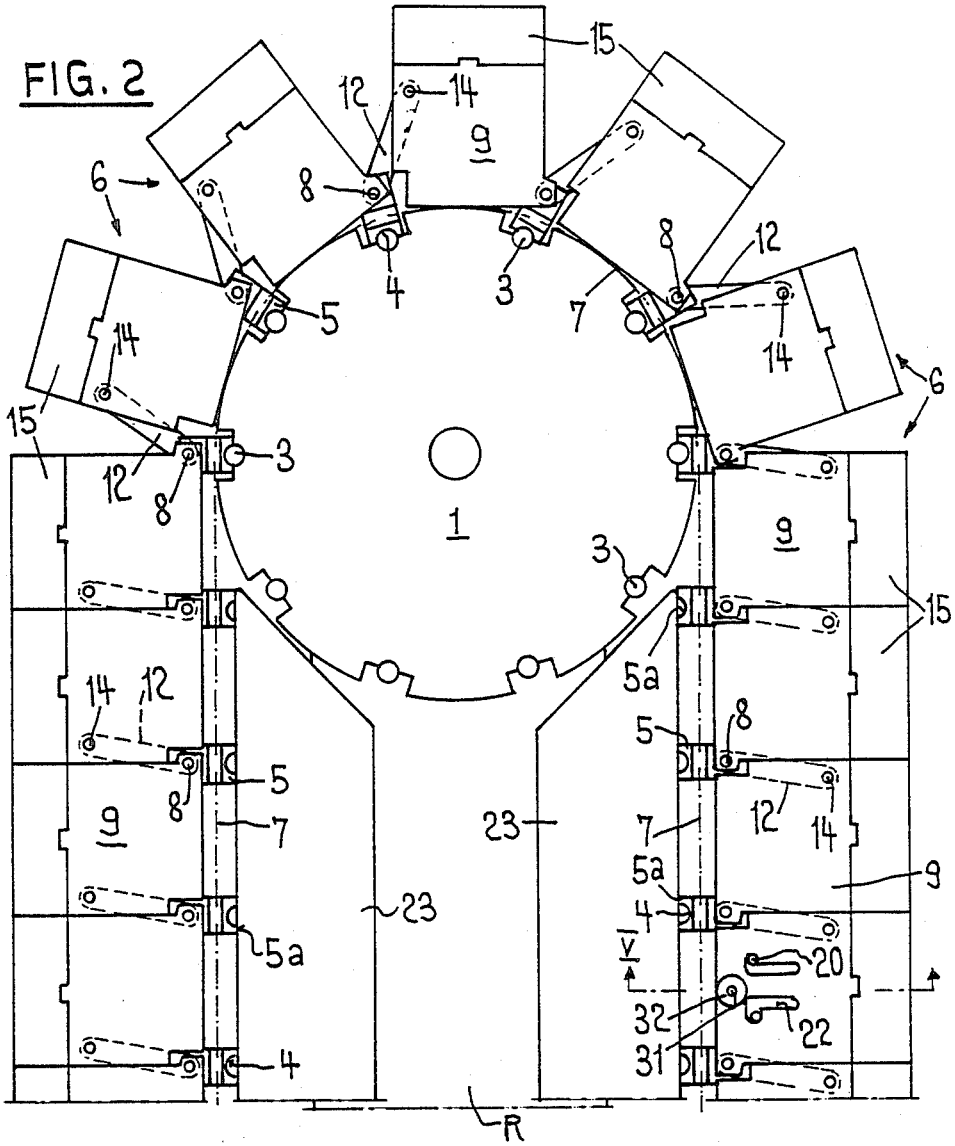
FIG. 2 shows a scaled up section of FIG. 1

The side dam, designed as an endless, chain like system is guided over two pulleys 1 and 2. The pulleys are furnished with cylindrical pins or supports 3 which are distributed along their circumference and are dimensioned so that that they engage with corresponding, half cylindrical notches 4, which are placed in the foot 5 of an element 6 of the side dam. The feet 5 of all elements are linked to a chain 7 by means of articulating joints.

Each foot 5 is pivoted on a pin 8 between two side plates 9 and 10 of a box shaped carrier. The side plates 9 and 10 are rigidly fastened together by means of bolts or rivets 11. A coupling bar 12 is pivoted on the pin 8 of each carrier 9, 10. At the other end, said bar is also hinged to the outer end of the neighboring carrier 9, 10 by means of a pin 14 in bearing bushes 13. Thus the carriers 9, 10 are connected to the outer side of the chain 7 in such a manner as to allow for a certain mobility, radially and tangentially of the carriers in relation to the chain. The side dam elements are not primarily supported on the pulleys 1 and 2 by way of the chain 7 or the carriers 9, 10, but by way of the feet 5 of the carriers. Each carrier 9, 10 bears a block which consists of a suited material, for example a refractory, metal, or a material that is protected by means of a refractory or chemical coat. Each block has a groove 16 in the middle which takes hold of a key 17 which is fastened to the outer side of the carriers 9, 10. A possibility for connecting the blocks to the carriers consists in placing an eye preferably on each side of the groove 16 and hooking one end of a tension spring 19 to an eye and the other end of each spring to a pin 20. The pins 20 are made hollow so they can be taken hold of by insertion of a spike, and they are retained in cavities 21 at the end of L-shaped slots 22. On the ends they are furnished with necks, by which they are secured axially between the side walls 9 and 10.

Figure 6:
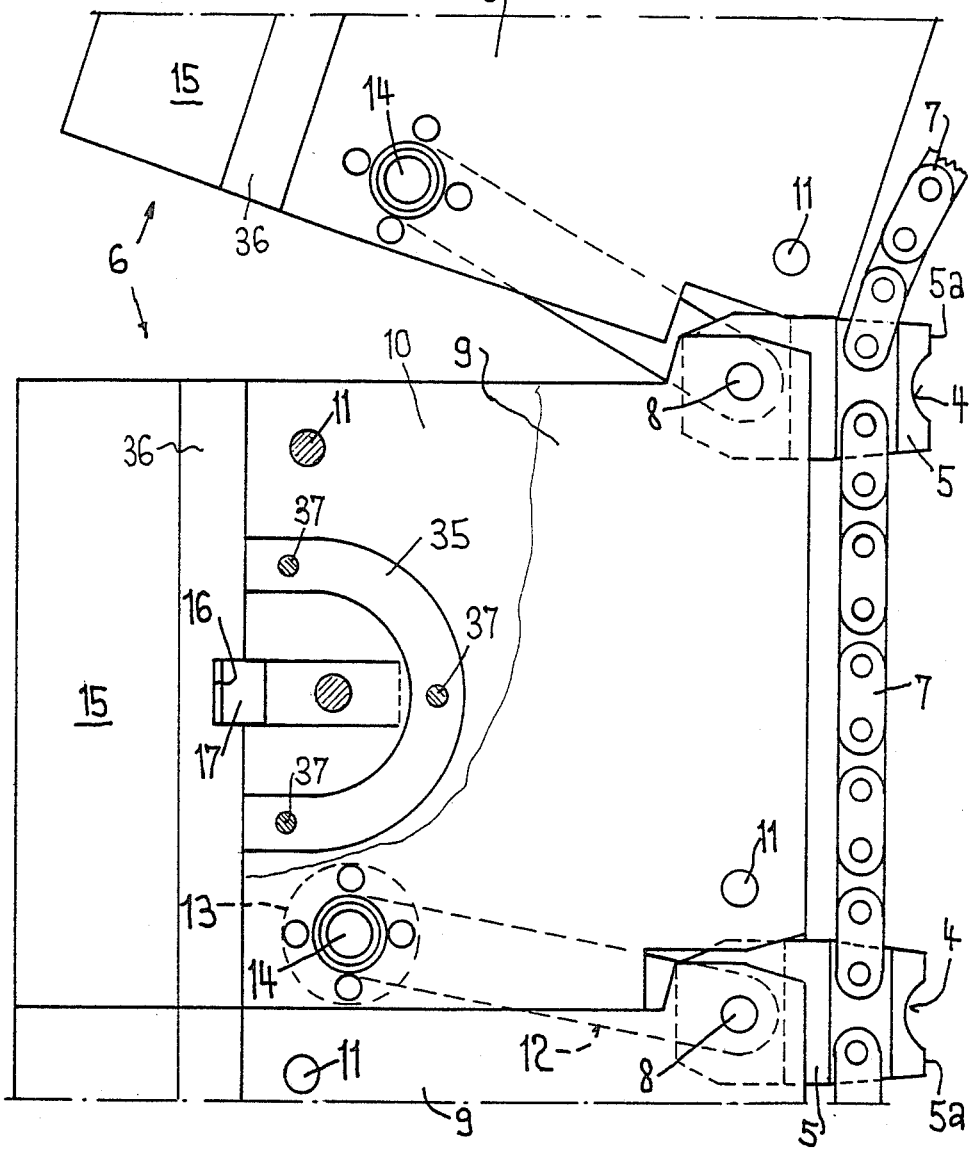
FIG. 6 and 7 show a section in correspondance to FIG. 3 and 4 of a variant of a side dam's individual elements whereby permanent magnets are used to hold the blocks.
Figure 7:
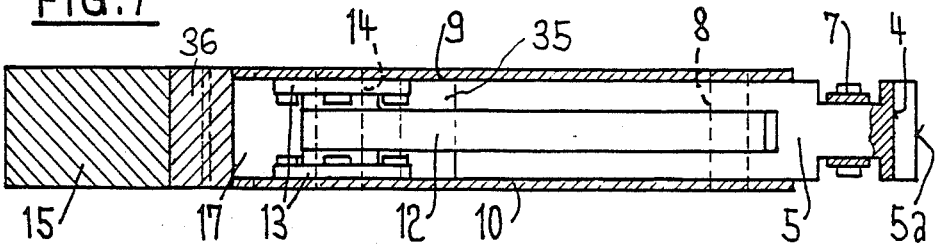

An other way of fastening the blocks 15 to the carriers 9, 10 is to retain them by means of magnetic force, whereby a permanent magnet 35 with sufficient attractive power is installed between the side walls by means of bolts 37 (FIG. 6). More than one and/or various types of magnets can be used. The intensity of the magnetic force is preferably so chosen as to ensure that the block is securely held in place during operation but can be removed and replaced by hand.

In case that ceramic or non magnetic blocks 15 are used, they can be furnished with a ferro magnetic plate on the side facing the magnet. The side plates 9, 10 are preferably made of an antimagnetic material such as austenitic steel sheet.

Between the pulleys 1 and 2 the feet 5 are supported on their level inside surfaces **5*a* by straight guide rails 23, thus allowing for the elements and the blocks 15 to travel on a straight and even path. In this zone the blocks 15 lie close together and form a tight lateral closing off of the casting mold 24. Furthermore they can be set between the casting mold walls at an adjustable depth. FIG. 1 shows the side dam elements together with a casting mold 25 behind them. It is provided for the blocks to travel on a straight path, when they pass the casting nozzle 26, thus ensuring a sealing of the mold between tip and side dams. The guide rails 23 and the bearings of the two pulleys 1 and 2 are mounted on a frame R which is pivoted on the axle of the lower pulley 2. The frame R is preferably pressed constantly towards the casting device and particularly against the side end of the casting tip by means of a strong spring 27 and the leverage 28. Further springs 29 are provided for to push the upper pulleys 1 upwards, thus putting a tension on the side dams. The side dam's principle of operation is practically explained by the above mentioned details. A driving device can be applied which moves the blocks downwards at a speed that corresponds to the motion of the cast product as shown in FIG. 1**. The blocks may also be pulled along by the casting which thus drives the side dams.

The length of the connection bars 12 and the arrangement of the pivots 8 and 14 of the neighboring carriers are so dimensioned as to allow for the carriers 9, 10 and the blocks 15 to be positioned in the same distance from the guide rails 23, on the straight sections of the side dam system thus ensuring a precise alignment of the outer surfaces of the blocks 15. Due to the connection rods 12, the elements swivel at the point of their changing of direction in such a way as to allow for the blocks to separate freely in the circumferential direction, and according to the swivelling of the connection rods they can also move radially inwards so that the critical outer edges **15*a* of the blocks 15 can not intrude into the side surface 30*a* of the solidified cast strip but separate smoothly therefrom. This process is illustrated clearly and in a somewhat exaggerated manner in the lower part of FIG. 1**.

Defect blocks 15 can be removed and replaced easily and even during operation on the freely accessible outer portion of the side dam. For this purpose, if tension springs are used to hold the blocks 15 in place, the pin 20 must simply be unhooked from the cavities 21 and led inwards through the slots 22, whereby the spring 19 is released and the block can be removed. Then a new block 15 is mounted, the spring 19 is hooked to the pin 20, which thereafter is led back into the cavities 21. If a magnetic holder as shown in FIG. 6 is used, the block to be exchanged can be removed by simply taking it off and replacing it by hand.

Figure 4:
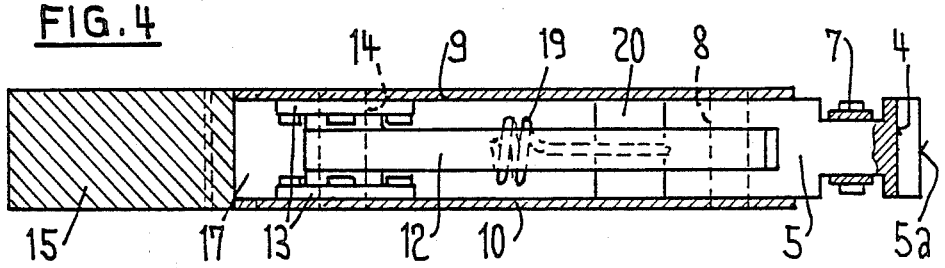
FIG. 4 shows a cross section of a side dam element.

As shown in FIG. 4, the blocks are made as thick as the carriers 9, 10. If thicker strips or billets are to be cast, the blocks can also be made thicker. Naturally the thickness of the casting nozzle must thereby also correspond to the thickness of the cast. In both cases the blocks 15 together with the carriers 9, 10 can be adjusted in a relatively wide range at practically any depth in between the mold walls 25, thereby establishing the width of the cast.

For the purpose of making this width adjustment, the frame into which the side dam with the leverage 28 and the spring 27 is mounted, can be placed on a sliding carriage, which can be adjusted sideways, whereby the the casting width is varied.

If the direction of casting is vertical, the side dam is guided sufficiently by the chain 7 which engages with the pulleys, and is guided sufficiently by the support of the feet 5 on the pins 3 of the pulleys, because there are practically no tilting moments acting on the elements. If the casting direction is horizontal or inclined, additional guidance might be necessary to avoid tilting of the side dam elements and to hold them in the casting plane.

Figure 5:
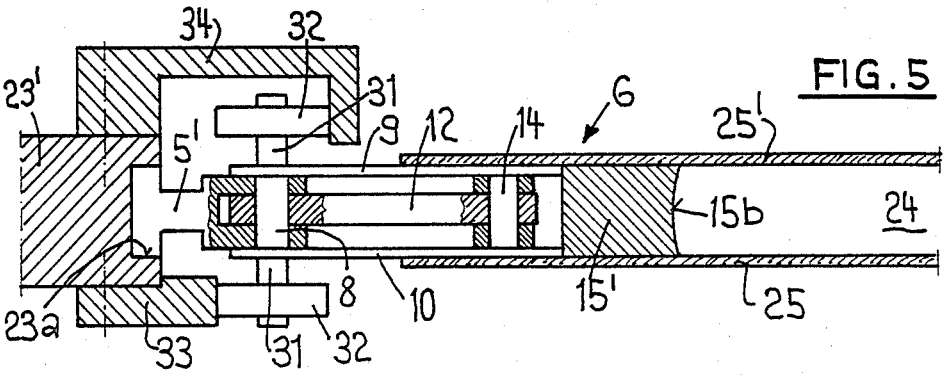
FIG. 5 shows a section V—V in FIG. 2 of a variant of an element and the components for its guidance.
Figure 3:
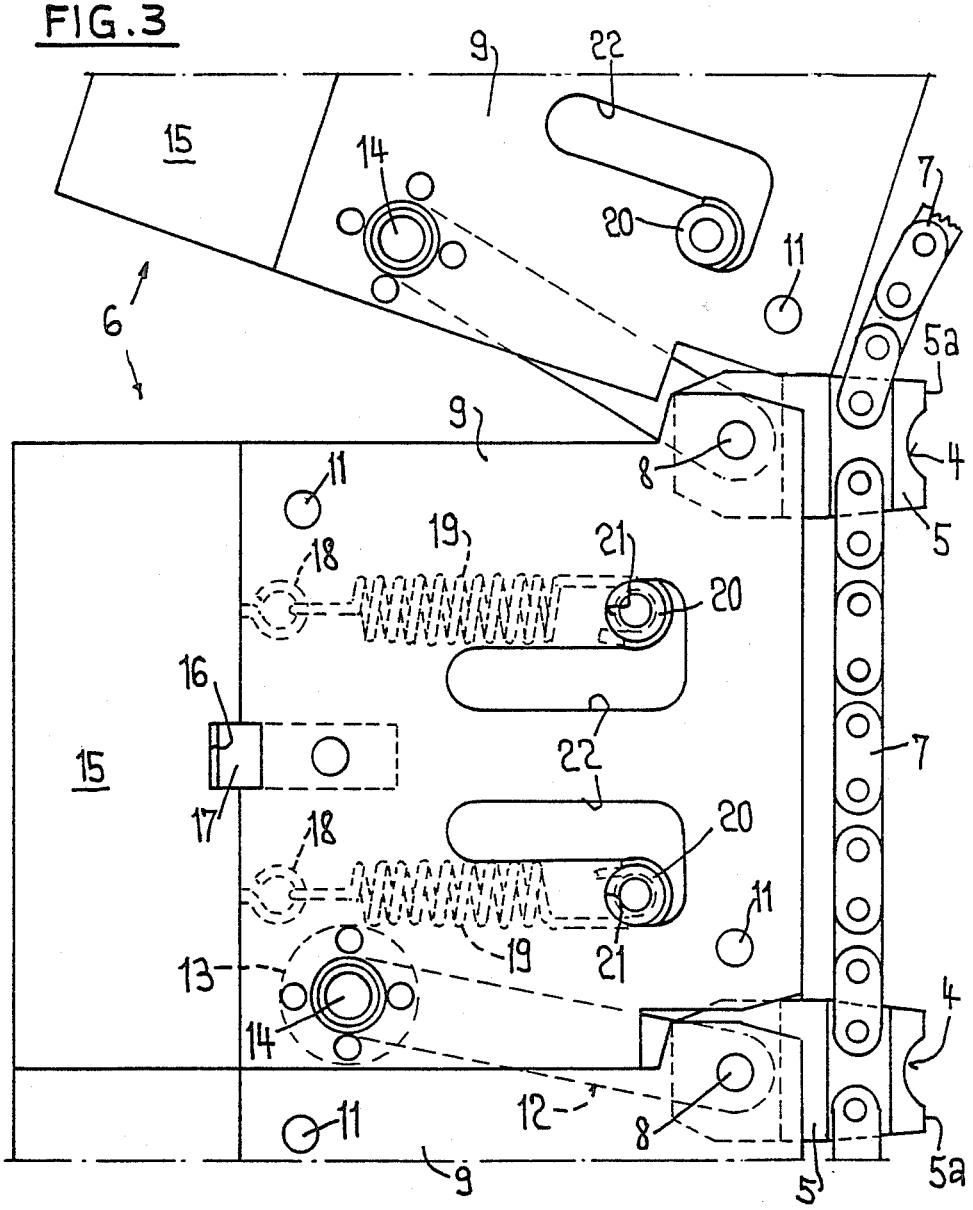
FIG. 3 shows the design of the individual elements of the side dam in a yet greater scale, whereby tension springs are used as holding devices for the blocks.

FIG. 5 shows such a design variant, in which corresponding parts are designated the same as in FIG. 1 to 4. Thereby one axle 31 protrudes from both side walls 9 and 10 of the carrier. Guiding rolls 32, which are additionally supported on guiding rails 33 and 34, are placed on said axle 31. The guiding rails are mounted on supports 23. Corresponding additional guiding rails 33 and 34 can also be placed at the turning points. The feet 5' engage with a groove 23*a* of a guiding rail 23', whereby the elements 6 are also supported in the vertical direction. The upper casting mold wall 25' is indicated in FIG. 5. Furthermore FIG. 5 shows a variant of the block 15, which is designated here as 15' and is furnished with a concave outer surface 15*b*. According to this concave surface of the block and of all blocks 15' a casting with convex edges is produced, a circumstance which is desirable in many cases, particularly when thick strips and/or steel is to be cast. In place of the pulleys 1 and 2 which support and move the feet 5 along, one could also provide chain sprocket wheels into which chain segments or a complete endless chain engage. In this case the feet 5 would have to envelope the chain on the out side and be connected to it with articulating joints, or the sprocket wheels would have to be furnished with openings for the accomodation of the feet.

What I claim is:

1. A side dam for the lateral closing off of the casting mold of a continuous casting machine with travelling molds, said side dam comprising; elements which are linked to each other in a chain-like manner, and which join in the area of the casting cavity and travel along with the cast, whereby the path of motion of the side dam lies in a plane that is parallel to the planes of the mold walls in the area of the casting cavity, wherein each element has a swivel mounted foot pivotally connected to a first side of said element and a pivot mounted connection rod connected to a second side, wherein said connection rod is connected to the foot of an adjacent element.

2. A side dam according to claim 1, wherein; each connection rod is pivotally connected to said element at a first end and pivotally connected to said foot at a second end.

3. A side dam according to claim 1, wherein; the elements each include a carrier, which is connected to the other carriers in a chain-like manner and said elements further include an exchangeable block, wherein each block is fastened to the corresponding carrier by means of detachable holding means.

4. A side dam according to claim 2, wherein; the feet are guiding devices configured for unrestricted travel over pulleys, such that they maintain a constant speed when they enter the casting mold area, wherein said elements are configured and mounted such that the distance between the center line of the casting mold and the side dam is not subject to any fluctuations during motion of the casting mold and side dams.

5. A side dam according to claim 3, wherein; the blocks include a refractory material.

6. A side dam according to claim 3, wherein; the blocks have a length of at least 100 to 250 mm.

7. A side dam according to claim 3, wherein; the carriers include two side plates which are connected rigidly to each other, and are spaced in such a way that the width of the carriers is not greater than the thickness of the blocks, whereby said holding means are placed between the plates.

8. A side dam according to claim 3, wherein; the blocks are held on the carriers by one of either springs or magnets.

9. A side dam according to claim 8, further including L-shaped slots in said carrier side plates, and transverse pin means for anchoring the springs to the blocks allowing for the spring to be put under tension, wherein the pin is configured for engagement in the slots.

10. A side dam according to claim 9, wherein; the pin is provided with a longitudinal hole.

11. A side dam according to claim 3, wherein; the carriers are swivel mounted on a first end to a first foot and are guided by means of a rod on a second end which is swivel mounted on one end below the block of an element and on the other end to the foot of an adjacent carrier.

12. A side dam according to claim 1, wherein said casting machine further includes a casting nozzle having an outlet, wherein; the side dam is operatively mounted for swiveling within the plane of motion of the side dam elements and for being pressed yieldingly against the outlet of the casting nozzle.

13. A side dam according to claim 1, wherein; the surface of each block establishing the lateral closing off of the casting mold, has an essentially concave profile.

14. A side dam according to claim 3, wherein said blocks are comprised of a metallic material having a refractory coating.

15. A side dam according to claim 3, wherein said blocks are comprised of a metallic material having a chemical coating.

* * * * *